US009434155B1

(12) United States Patent
Linder et al.

(10) Patent No.: US 9,434,155 B1
(45) Date of Patent: Sep. 6, 2016

(54) METHOD AND SYSTEM FOR PRINTHEAD ALIGNMENT BASED ON PRINT MEDIUM WIDTH

(71) Applicant: Xerox Corporation, Norwalk, CT (US)

(72) Inventors: Michael J. Linder, Walworth, NY (US); Paul S. Bonino, Ontario, NY (US); David M. Thompson, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/840,495

(22) Filed: Aug. 31, 2015

(51) Int. Cl.

| | |
|---|---|
| ***B41J 2/045*** | (2006.01) |
| ***B41J 11/00*** | (2006.01) |
| *B41J 2/21* | (2006.01) |
| *B41J 2/155* | (2006.01) |

(52) U.S. Cl.
CPC ..... *B41J 2/04505* (2013.01); *B41J 11/0065* (2013.01); *B41J 2/155* (2013.01); *B41J 2/2146* (2013.01)

(58) Field of Classification Search
CPC B41J 2/04541; B41J 2/0458; B41J 2/04581; B41J 2/04588; B41J 2/04543; B41J 11/0065; B41J 2/2146; B41J 2/155; B41J 2/04505
USPC ..... 347/9
See application file for complete search history.

(56) References Cited

U.S. PATENT DOCUMENTS

| | | | |
|---|---|---|---|
| 4,940,996 A | 7/1990 | Paton et al. | |
| 5,093,674 A | 3/1992 | Storlie | |
| 5,500,667 A | 3/1996 | Schwiebert et al. | |
| 5,589,865 A | 12/1996 | Beeson | |
| 5,633,668 A | 5/1997 | Schwiebert et al. | |
| 6,017,113 A | 1/2000 | Nicoloff, Jr. et al. | |
| 6,238,112 B1 * | 5/2001 | Girones | B41J 2/2139 347/19 |
| 6,412,907 B1 | 7/2002 | Castelli et al. | |
| 6,457,806 B2 | 10/2002 | Hickman | |
| 6,505,906 B1 | 1/2003 | Bland et al. | |
| 6,536,894 B1 | 3/2003 | Rasmussen et al. | |
| 6,587,652 B2 | 7/2003 | Metzler | |

(Continued)

FOREIGN PATENT DOCUMENTS

| | | |
|---|---|---|
| EP | 0 340 960 A1 | 8/1989 |
| EP | 1 447 226 A1 | 8/2004 |

(Continued)

OTHER PUBLICATIONS

Nguyen, Thinh H., Non-final Office Action for U.S. Appl. No. 12/504,857, mailed Aug. 31, 2011 (8 pages).

(Continued)

*Primary Examiner* — Manish S Shah
*Assistant Examiner* — Yaovi M Ameh
(74) *Attorney, Agent, or Firm* — Maginot Moore & Beck LLP

(57) ABSTRACT

An inkjet printer includes a first printhead and a second printhead in a print zone. A controller operates an actuator to move the first printhead to a first position to enable every inkjet in a plurality of inkjets in the first printhead to eject ink onto a surface of a print medium. The controller operates a first inkjet in the first printhead that overlaps with a second inkjet in the second printhead in a cross-process direction to eject ink from only one of the inkjets for each pixel of image data that corresponds to the location of the first and second inkjets in the cross-process direction.

24 Claims, 7 Drawing Sheets

(56) References Cited

U.S. PATENT DOCUMENTS

| | | | | |
|---|---|---|---|---|
| 6,739,687 | B1 | 5/2004 | Rasmussen et al. | |
| 6,788,432 | B1 | 9/2004 | Garcia et al. | |
| 6,799,830 | B1 | 10/2004 | Brookfield et al. | |
| 7,167,770 | B1 | 1/2007 | Akira | |
| 7,278,699 | B2 | 10/2007 | Drake et al. | |
| 7,691,280 | B2 | 4/2010 | Waldrop et al. | |
| 8,282,190 | B2 | 10/2012 | Silverbrook et al. | |
| 8,292,398 | B2 | 10/2012 | Mizes et al. | |
| 8,517,502 | B2 | 8/2013 | Mizes et al. | |
| 2002/0140769 | A1* | 10/2002 | Kuwahara | B41J 2/155 347/40 |
| 2003/0132979 | A1 | 7/2003 | Taylor | |
| 2003/0156148 | A1 | 8/2003 | King et al. | |
| 2003/0234851 | A1 | 12/2003 | Booth et al. | |
| 2004/0085383 | A1 | 5/2004 | Rasmussen | |
| 2006/0209112 | A1* | 9/2006 | Nunokawa | B41J 2/2132 347/15 |
| 2006/0268061 | A1* | 11/2006 | Jeong | B41J 2/2139 347/47 |
| 2006/0289419 | A1* | 12/2006 | Ueno | G03G 15/2042 219/216 |
| 2008/0124158 | A1 | 5/2008 | Folkins | |
| 2008/0238974 | A1* | 10/2008 | Takahashi | B41J 2/04551 347/14 |
| 2008/0278527 | A1 | 11/2008 | Newell | |
| 2008/0314276 | A1 | 12/2008 | Gothait et al. | |
| 2009/0141110 | A1 | 6/2009 | Gervasi et al. | |
| 2009/0293750 | A1 | 12/2009 | Haenni et al. | |
| 2010/0013882 | A1 | 1/2010 | Mizes et al. | |
| 2011/0012958 | A1 | 1/2011 | Mantell et al. | |
| 2012/0206530 | A1* | 8/2012 | Mizes | B41J 2/2146 347/19 |

FOREIGN PATENT DOCUMENTS

| | | | |
|---|---|---|---|
| EP | 1 609 602 | A3 | 12/2005 |
| EP | 1 669 204 | A1 | 6/2006 |
| WO | 01/56798 | A1 | 8/2001 |
| WO | 2014/041341 | A1 | 3/2014 |

OTHER PUBLICATIONS

Lockman, David M., Response to Non-final Office Action for U.S. Appl. No. 12/504,857, submitted Nov. 30, 2011 (11 pages).

United Kingdom Search Report corresponding to UK Application No. 1107830.0, United Kingdom Intellectual Property Office, Newport, South Wales, UK, Sep. 7, 2011 (3 pages).

European Search Report corresponding to European Patent Application 101697521, European Patent Office, Rijswijk, Netherlands, Oct. 26, 2010 (6 pages).

* cited by examiner

METHOD AND SYSTEM FOR PRINTHEAD ALIGNMENT BASED ON PRINT MEDIUM WIDTH

TECHNICAL FIELD

This disclosure relates generally to printhead alignment in an inkjet printer having one or more printheads, and, more particularly, to the positioning of printheads to place every inkjet in a plurality of printheads over a print medium in a print zone.

BACKGROUND

Ink jet printers have printheads that operate a plurality of inkjets that eject liquid ink onto an image receiving member. The ink may be stored in reservoirs located within cartridges installed in the printer. Such ink may be phase-change, aqueous, oil, solvent-based, UV curable ink, or an ink emulsion. A typical full width scan inkjet printer uses one or more printheads. Each printhead typically contains an array of individual nozzles for ejecting drops of ink across an open gap to an image receiving member to form an image. The image receiving member may be a continuous web of recording media or a series of media sheets. In some print modes, the array of printheads has a width that exceeds the width of the print medium. For example, some inkjet printers include arrays of printheads with an array of inkjets that span a width of 48 cm in the print zone, while many print media have narrower widths, such as a letter size media sheet that has a width of only 21.6 cm and a length of only have width of only 27.9 cm.

During prolonged printing operations, only a portion of the inkjets in the printheads form printed images on the print media, while other inkjets that are located in regions of the print zone beyond the edges of the print medium remain idle. The liquefied ink in the idle inkjets may dry out due to evaporation through the inkjet nozzle. The dried ink in the inkjets renders the inkjets inoperable. The printer must perform purge operations or other printhead maintenance operations to return the inoperable inkjets to working order prior to performing printing operations on larger media sheets that receive ink from the inoperable inkjets. The maintenance process often consumes both ink and time, which decreases the effective throughput of the printer. Consequently, improvements to inkjet printers to reduce the occurrence of inoperable inkjets during printing operations for print media with a wide range of widths would be beneficial.

SUMMARY

In one embodiment, a method for operating printheads in a print zone reduces occurrences of inoperable inkjets in the printheads being used to print on media of varying widths. The method includes operating with a controller a first actuator to move in a cross-process direction a first printhead having a first plurality of inkjets from a first position at which only a first portion of the first plurality of inkjets are positioned to eject ink onto a surface of a print medium and a second portion of the first plurality of inkjets are not positioned to eject ink onto the surface of the print medium to a second position at which both the first portion and the second portion of the first plurality of inkjets are positioned to eject ink onto the print medium and a subset of the first portion of the first plurality of inkjets overlaps in the cross-process direction with a first portion of a second plurality of inkjets in a second printhead, and operating with the controller a plurality of inkjets each printhead of a plurality of printheads including the first plurality of inkjets in the first printhead and the second plurality of inkjets in the second printhead to eject drops of ink across a full width of a document zone on the surface of the print medium while each printhead in the plurality of printheads remains stationary in the cross-process direction.

In another embodiment, an inkjet printer operates a plurality of printheads in a print zone to reduce occurrences of inoperable inkjets in the printheads being used to print on media of varying widths. The printer includes a plurality of printheads in a print zone including a first printhead having a first plurality of inkjets and a second printhead having a second plurality of inkjets, a first actuator operatively connected to the first printhead and configured to move the first printhead in a cross-process direction, and a controller operatively connected to the first printhead, the second printhead, and the first actuator. The controller is configured to operate the first actuator to move in a cross-process direction the first printhead from a first position at which only a first portion of the first plurality of inkjets are positioned to eject ink onto a surface of a print medium in the print zone and a second portion of the first plurality of inkjets are not positioned to eject ink onto the surface of the print medium to a second position at which both the first portion and the second portion of the first plurality of inkjets are positioned to eject ink onto the print medium and a subset of the first portion of the first plurality of inkjets overlaps in the cross-process direction with a first portion of the second plurality of inkjets in a second printhead, and operate the plurality of inkjets each printhead of a plurality of printheads including the first plurality of inkjets in the first printhead and the second plurality of inkjets in the second printhead to eject drops of ink across a full width of a document zone on the surface of the print medium while each printhead in the plurality of printheads remains stationary in the cross-process direction.

BRIEF DESCRIPTION OF THE DRAWINGS

The foregoing aspects and other features of a printer that is configured to align printheads to position inkjets in the printheads over a print medium in print zone are explained in the following description, taken in connection with the accompanying drawings.

DETAILED DESCRIPTION

Figure 1:
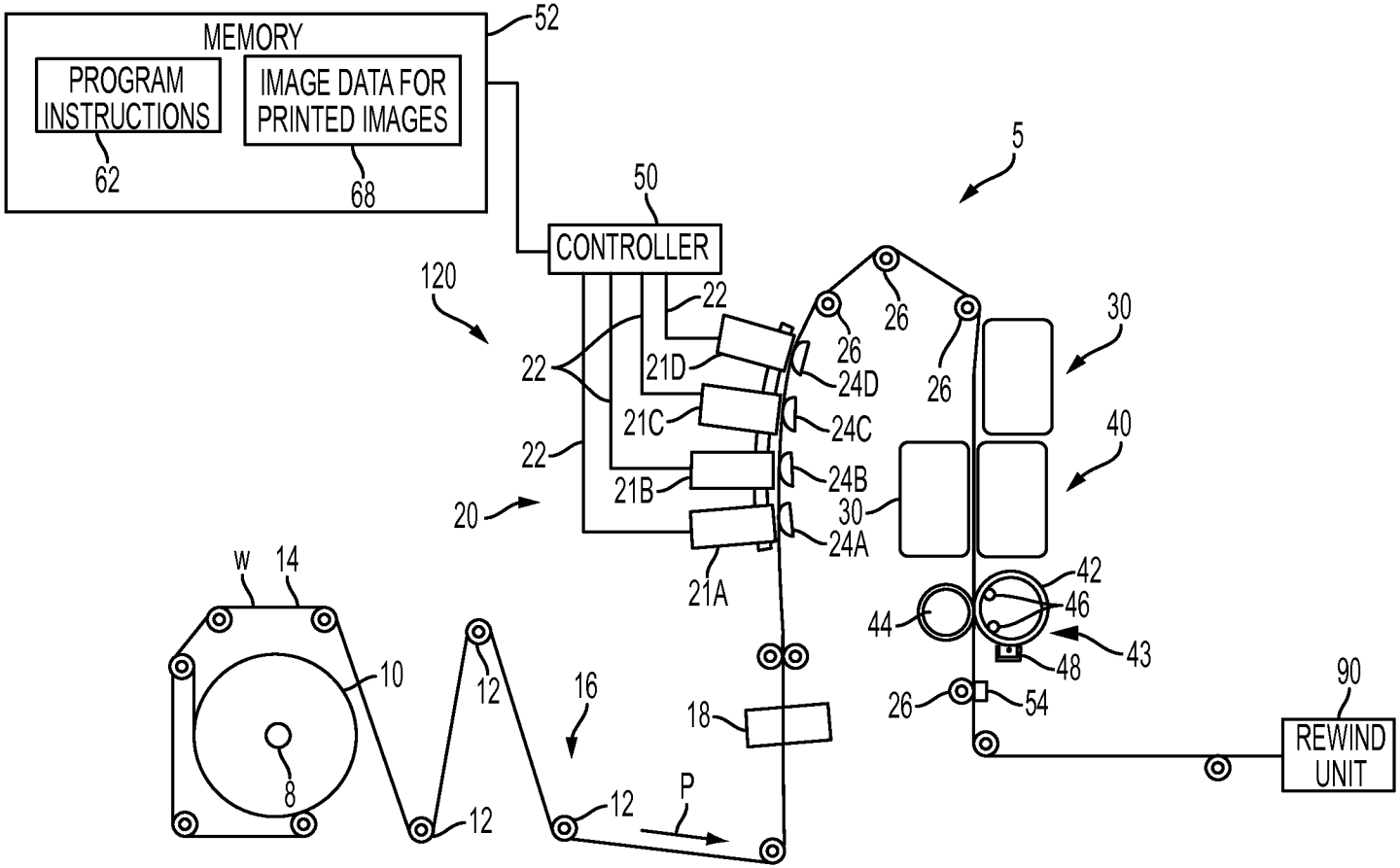
FIG. 1 is a schematic diagram of a continuous media inkjet printer that includes a print zone with multiple arrays of printheads that form printed images on a continuous print medium.

For a general understanding of the environment for the system and method disclosed herein as well as the details for the system and method, reference is made to the drawings. In the drawings, like reference numerals have been used throughout to designate like elements.

As used herein, the word "printer" encompasses any apparatus that produces images with colorants on media, such as digital copiers, bookmaking machines, facsimile machines, multi-function machines, three-dimensional object printers, and the like. As used herein, the term "process direction" refers to a direction of movement of an image receiving surface through the printer. For example, a continuous media web pulled from a roll of paper or other suitable print medium moves in the process direction along a media path through a printer. A media transport in the printer uses one or more actuators, such as electric motors, to move the print medium past one or more printheads in the print zone to receive ink images and passes other printer components, such as heaters, fusers, pressure rollers, and on-sheet optical imaging sensors, that are arranged along the media path. As used herein, the term "cross-process" direction refers to an axis that is perpendicular to the process direction along the image receiving surface. Examples of image receiving surfaces include the surfaces of print media such as paper or the surfaces of indirect image receiving members including rotating drums, endless belts, and platen.

As used herein, the term "printhead" refers to a group of inkjet ejectors arranged in fixed physical relationship to one another. The term "print bar" as used in this document refers to a linear arrangement of printheads that are configured for linearly movement as a group. The printhead group collectively referred to as a print bar is operatively connected to an actuator to enable the movement of the entire group in the cross-process direction. Some or all of the printheads on a print bar may be operatively connected to actuators that enable the printheads to move in a cross-process direction independently with respect to the other printheads on the print bar. In a staggered print bar arrangement, printheads are arranged in two groups or print bars that are positioned relative to one another in a staggered pattern. The staggered configuration enables the printheads on the two print bars to emit ink drops in a continuous line across an image receiving member in the cross-process direction.

As used herein, the term "document zone" refers to a region of a surface of a print medium where the printer forms printed images. For example, in many configurations a printer forms printed text and images in a document zone that covers only a portion of a print medium with margins around the document zone. In other configurations the printer forms printed images on the entire surface of the print medium and the document zone covers the entire surface of the print medium. As used herein, the term "inter-document zone" refers to a region of the surface of a print medium that lies between two document zones. Inter-document zones often occur in elongated print media, such as rolls of paper, where the printer forms multiple printed images in a series of document zones along the length of the paper roll with inter-document zones that separate adjacent document zones.

As used herein, the term "activated printhead" refers to a printhead in a print zone that ejects ink onto a print medium during a print job. Note that not every inkjet in an activated printhead necessarily ejects ink drops to form a portion of the image since different sets of image data call for different patterns of printed ink that may not require activation of every inkjet in a printhead. As described in more detail below, during a print job each inkjet in one or more activated printheads ejects ink to reduce or eliminate the occurrences of inoperable inkjets due to the ink in the inkjet drying out. Some inkjets eject ink to form printed images. Inkjets in the printhead that do not eject ink to form printed images form printed marks in margins and inter-document zone regions or in a low-density pattern that is visually imperceptible within a printed image to prevent the inactive inkjets from drying out during operation.

As used herein, the term "inactive printhead" refers to a printhead having no inkjets used to produce a printed image during a print job. In some printing configurations, the printhead arrays in the print zone are substantially wider than the width of the print medium in the cross-process direction. The printheads in the print zone that are not required to form the printed image are the inactive printheads. Of course, in some configurations every printheads in the print zone includes at least one inkjet that forms a portion of the printed image and all of the printheads remain active in those configurations. As described in more detail below, a maintenance unit in a printer places a cap over one or more inactive printheads to reduce or eliminate the occurrence of inoperable inkjets due to dry out of the ink in the inkjets.

FIG. 1 is a schematic diagram of an inkjet printer 5. FIG. 1 is a simplified schematic view of the direct-to-sheet, continuous-media, phase-change inkjet printer 5, that is configured to generate test patterns using a plurality of printheads positioned in a print zone in the printer. A media supply and handling system is configured to supply a long (i.e., substantially continuous) web of media 14 of "substrate" (paper, plastic, or other printable material) from a media source, such as a spool of media 10 mounted on a web roller 8. The printer includes the web roller 8, media conditioner 16, print zone or printing station 20, and rewind unit 90. The rewind unit 90 winds the media web 14 onto a roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along an expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a printing station 20 that includes a series of color units 21A, 21B, 21C, and 21D, each color unit effectively extending across the width of the media and being able to place a marking agent directly (i.e., without use of an intermediate or offset member) onto the moving media. The controller 50 is operatively connected to the color units 21A-21D through control lines 22. Each of the color units 21A-21D includes a plurality of printheads positioned in a staggered arrangement in the cross-process direction over the media web 14. As is generally familiar, each of the printheads can eject a single color of ink, one for each of the colors typically used in four color printing, namely, cyan, magenta, yellow, and black (CMYK). The controller 50 of the printer receives velocity data from encoders mounted proximately to rollers positioned on either side of the portion of the path opposite the four color units to compute the position of the web as moves past the printheads. The controller 50 uses these data to generate timing signals for actuating the inkjets in the printheads to enable the four colors to be ejected with a reliable degree of accuracy for registration of the differently color patterns to form four primary-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of color units and can print inks having colors other than CMYK.

In the illustrative embodiment of FIG. 1, the printer 5 uses four different colors of "phase-change ink," by which is meant that the ink is substantially solid at room temperature and substantially liquid when heated to a phase change ink melting temperature for jetting onto the imaging receiving surface. Alternative printer embodiments use a single color of ink or a different number of ink colors. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink can also be heated before being ejected by the inkjets of the printhead. Alternative embodiments of the printer 5 use aqueous inks that are liquid at room temperature. As used herein, liquid ink refers to melted solid ink, heated gel ink, or other known forms of ink, such as aqueous inks, ink emulsions, ink suspensions, ink solutions, or the like.

Associated with each of color units 21A-21D is a corresponding backing member 24A-24D, respectively. The backing members 24A-24D are typically in the form of a bar or roll, which is arranged substantially opposite the printhead on the back side of the media. Each backing member is used to position the media at a predetermined distance from the printhead opposite the backing member. In the embodiment of FIG. 1, each backing member includes a heater that emits thermal energy to heat the media to a predetermined temperature that, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the color units 21A-21D eject ink at a temperature typically significantly higher than the temperature of the media web 14. Consequently, the ink heats the media. Therefore, other temperature regulating devices may be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path, the media web 14 moves over guide rollers 26 to one or more "mid-heaters" 30. A mid-heater 30 can use contact, radiant, conductive, and/or convective heat to control a temperature of the media. Depending on the temperature of ink and paper at rollers 26, this "mid-heater" can add or remove heat from the paper and/or ink. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly 40 includes any suitable device or apparatus for fixing images to the media including heated or unheated pressure rollers, radiant heaters, heat lamps, and the like. In the embodiment of FIG. 1, the fixing assembly includes a "spreader" 43, that applies a predetermined pressure, and in some implementations, heat, to the media. The function of the spreader 40 is to take what are essentially droplets, strings of droplets, or lines of ink on web 14 and smear them out by pressure and, in some systems, heat, so that spaces between adjacent drops are filled and image solids become uniform. In addition to spreading the ink, the spreader 40 also improves image permanence by increasing ink layer cohesion and/or increasing the ink-web adhesion. The spreader 43 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like. In another printer embodiment that employs aqueous ink, the fixing assembly 40 does not include a spreader, such as the spreader 40, but includes one or more heaters that dry aqueous ink on the media web after the media web passes through the print zone 20. In a UV ink printer embodiment, the fixing assembly 40 includes UV light sources that direct UV radiation at the ink to cross-link and fix the ink to the surface of the media web.

In one practical embodiment, the roller temperature in spreader 40 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side.

The spreader 40 also includes a cleaning/oiling station 48 associated with image-side roller 42. The station 48 cleans and/or applies a layer of some release agent or other material to the roller surface. In the printer 5, the release agent material is an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment, the media is maintained at a high temperature during the printing operation to enable the spreader 40 to spread the ink while the ink is in a liquid or semi-liquid state.

Operation and control of the various subsystems, components and functions of the printer 5 are performed with the aid of the controller 50. The controller 50 is implemented with general or specialized programmable processors that execute programmed instructions. The instructions and data required to perform the programmed functions are stored in a memory 52 that is operatively connected to the controller 50. The memory 52 includes volatile data storage devices such as random access memory (RAM) and non-volatile data storage devices including magnetic and optical disks or solid state storage devices. The processors, their memories, and interface circuitry configure the controllers and/or print engine to perform the test pattern formation and image data analysis processes described herein. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

As described in more detail below, the controller 50 executes stored program instructions 62 in the memory 52 to form printed images on the media web 14 with reference to image data 68. The image data 68 include two-dimensional arrangements of pixels that specify colors at different locations in a printed image, and the controller 50 processes the pixels in the image data to select inkjets and control the timing of operation of the inkjets that form drops of ink in the printed image on the media web 14 using inkjets in the printheads of one or more of the color units 21A-21. As described below, the controller 50 identifies the width of the media web 14 in the cross-process direction with reference to either information in the image data 68 that specify the media width or with reference to one or more sensors in the printer 5 that detect the width of the media web 14. The controller 50 operates actuators to move the printheads in the color units 21A-21D into different positions based on the width of the media web 14. In some configurations, the controller 50 moves printheads over the media web 14 so that all of the inkjets in each printhead are positioned over the surface of the media web 14. The controller 50 moves any remaining printheads that are not required to form any portion of the image on the media web 14 away from the media web 14 to a maintenance unit or other suitable location in the print zone 20. The maintenance unit places a cap over the inkjets in the remaining printheads for the duration of the print job. The caps prevent the inkjets in the inactive printheads from drying out, and the controller 50 returns the printheads to operation if a subsequent print job uses a wider print medium that requires additional printheads.

During the print job, the controller 50 operates inkjets in overlapping portions of two or more printheads in each color unit in a proportional manner to form the printed images with an expected amount of ink across the full width of the printed image. The controller 50 also operates any inkjets that are over the surface of the media web 14 but do not participate in forming the printed images to ensure that all inkjets in the active printheads are operated during the print job to reduce or eliminate the occurrence of inkjets that dry out and become clogged during the print job.

The printer 5 includes an optical sensor 54 that is configured to generate image data corresponding to the media web 14 and printed test patterns or other marks formed on the media web 14. The optical sensor is configured to generate signals indicative of reflectance levels of the media, ink, or backer roll opposite the sensor to enable detection of, for example, the presence and/or location of ink drops jetted onto the receiving member by the inkjets of the printhead assembly. The optical sensor 54 includes an array of optical detectors mounted to a bar or other longitudinal structure that extends across the width of an imaging area on the image receiving member.

In one embodiment, the imaging area is approximately twenty inches wide in the cross-process direction the sensor 54 generates scanned image data at a resolution of 600 dots per inch (DPI) in the cross-process direction. In this embodiment, over 12,000 optical detectors are arrayed in a single row along the bar to generate a single scanline of image data corresponding to a line across the image receiving member. The optical detectors are configured in association in one or more light sources that direct light towards the surface of the image receiving member. The optical detectors receive the light generated by the light sources after the light is reflected from the image receiving member, such as the media web 14. The magnitude of the electrical signal generated by an optical detector corresponds to the amount of light reflected into the detector from the surface of the media web 14, including bare portions of the media web surface and portions that carry printed ink patterns. The magnitudes of the electrical signals generated by the optical detectors are converted to digital values by an appropriate analog/digital converter.

Figure 2:
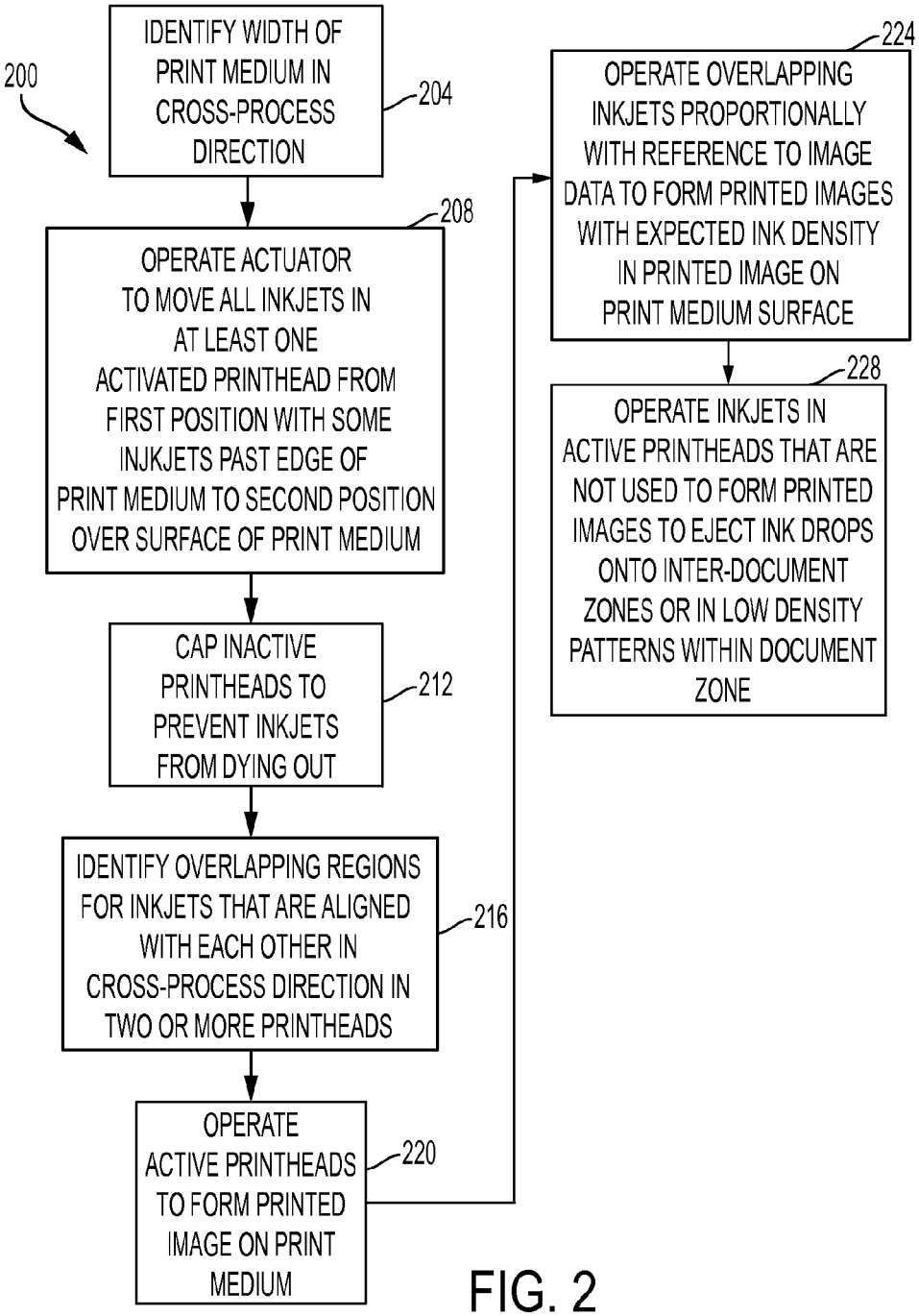
FIG. 2 is a block diagram of a process for moving and operating printheads in a print zone to reduce or eliminate the occurrences of inoperable inkjets due to ink in the inkjets drying out and becoming clogged.

FIG. 2 depicts a process 200 for operation of an inkjet printer to reduce or eliminate occurrences of inoperable inkjets for print media that are narrower than the full width of printheads in a print zone. In the discussion below, a reference to the process 200 performing a function or action refers to the operation of a controller to execute stored program instructions to perform the function or action in association with one or more components in an inkjet printer. The process 200 is described in conjunction with the printer 5 of FIG. 1 for illustrative purposes.

Process 200 begins as the controller 50 identifies the width of the print medium in the cross-process direction at the beginning of a print job (block 204). In one embodiment, the controller 50 identifies the dimensions, including the width of the print medium, with reference to metadata that are associated with the image data for the printed images 68. In another embodiment, the controller 50 uses the image sensor 54 to identify the width of the media web 14 based on differences in the level of light that is reflected from the media web 14 and a background, such as the surface of a backing roller 26 that supports the media web 14. The controller 50 identifies the width of the media web 14 in the cross-process direction with reference to a number of pixels of scanned image data that include the media web 14 and with reference to a predetermined width of each pixel in the cross-process direction. In still another embodiment, the controller 50 identifies the width of the media web 14 using one or more sensors that are located along the media path including, but not necessarily limited to, contact switches, light-break sensors, and the like.

Process 200 continues as the controller 50 operates actuators in the print zone to move one or more of the active printheads in an array of printheads to a position that enables every inkjet in the active printheads to eject ink onto the print medium (block 208). In the printer 5, the controller 50 operates one or more electromechanical actuators, such as stepper motors or other suitable electromechanical devices, to adjust the cross-process direction positions of one or more activated printheads. The controller 50 moves the printheads to place each inkjet in the activated printheads in a position to eject ink drops onto the print medium. The controller 50 identifies the position for each active printhead with reference to a predetermined width of the plurality of the ejectors in each printhead in the cross-process direction and the identified width of the print medium to identify a position where every inkjet in the active printheads is in a position to eject ink onto the surface of the print medium. Portions of the printheads that do not include inkjets, such as sections of the housing of each printhead, optionally extend past the edges of the print medium in the cross-process direction.

Figure 3A:
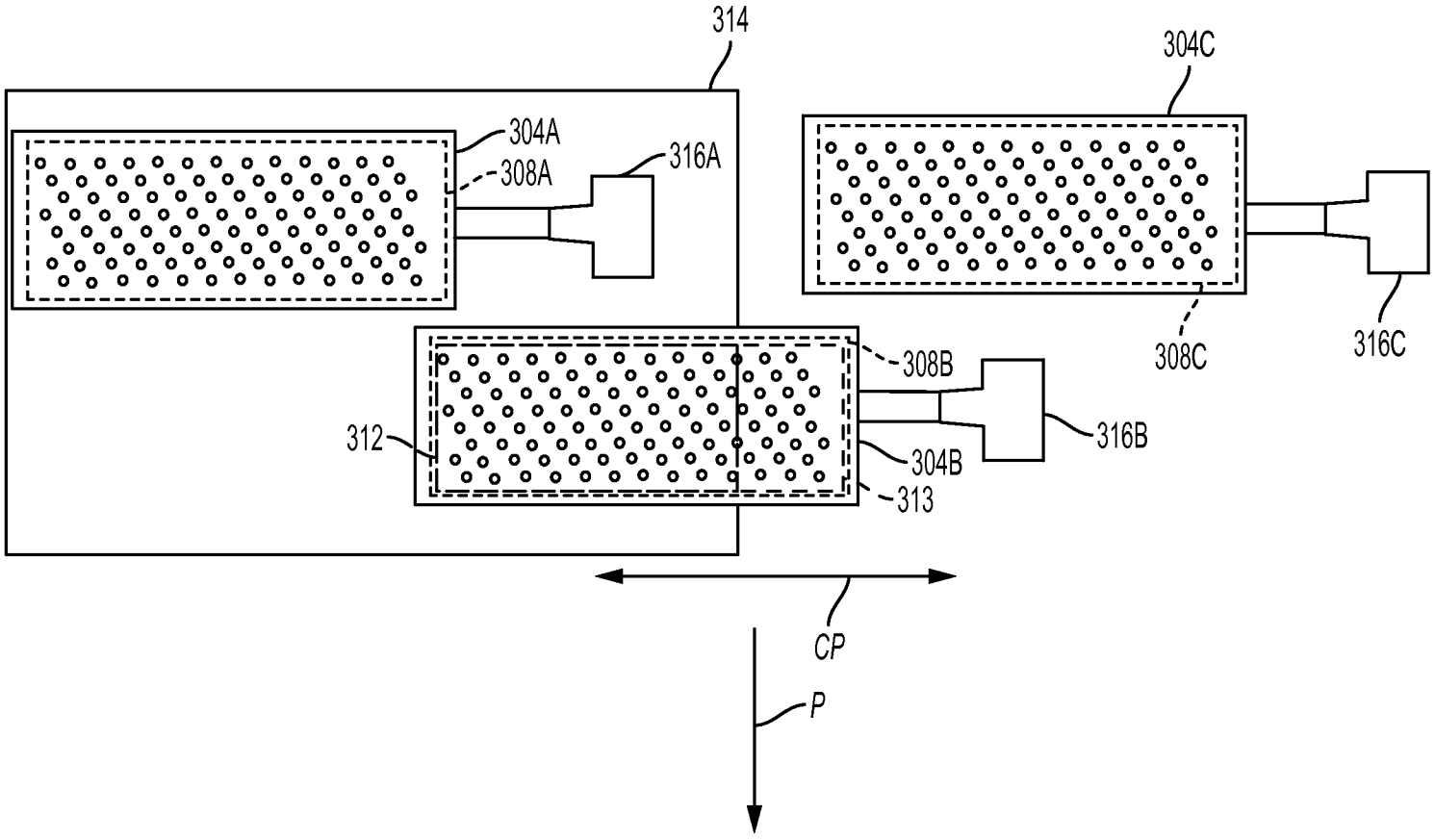
FIG. 3A is a schematic diagram of a portion of the printheads in a printhead array of the printer in FIG. 1 with a print medium having a first width.
Figure 3B:
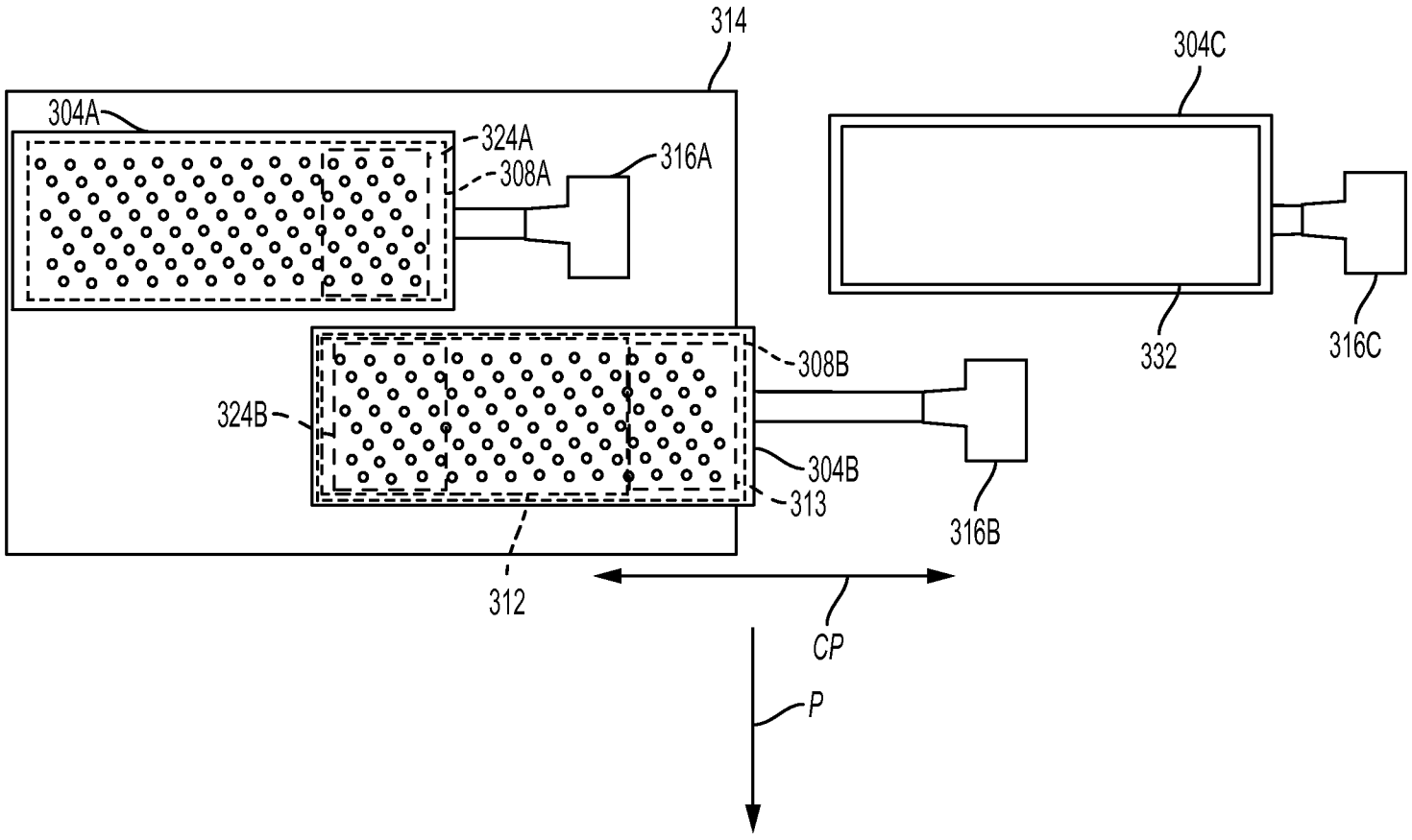
FIG. 3B is a schematic diagram of the printheads in FIG. 3A with one printhead being moved to position all of the inkjets in the printhead over the print medium and another printhead being capped.

FIG. 3A-FIG. 3B and FIG. 4A-FIG. 4B depict the printhead movement process in more detail. FIG. 3A depicts one arrangement of printheads in a printhead array before the controller 50 operates an actuator to move one or more of the printheads. FIG. 3A includes a simplified depiction of printheads 304A, 304B, and 304C. In some configurations of the printer 5, the printhead arrays in the color units 21A-21D each typically include a seven printheads in an interleaved arrangement with one row of four printheads and another row of three printheads. Some of the printheads in the printer 5 are omitted from FIG. 3A-FIG. 4B for clarity, but the processes described herein apply to printhead arrays with two or more printheads. Electromechanical actuators 316A, 316B, and 316C are operatively connected to the printheads 304A, 304B, and 304C, respectively. The controller 50 operates one or more of the actuators 316A-316C to move the printheads along the cross-process direction CP. FIG. 3A and FIG. 3B also depict a print medium 314 that moves in the process direction P past the printheads.

FIG. 3A depicts an example of a default configuration of the printheads 304A-304C in a configuration for printing full-width print media. In FIG. 3A, the printheads 304A-304C are arranged in a "stitched" configuration along the cross-process direction. In the stitched configuration, the inkjets 308A in the printhead 304A are aligned end-to-end with the inkjets 308B in the printhead 304B to enable the printheads 304A and 304B to eject ink drops in a continuous line along the cross-process direction. The printhead 304B and 304C are also aligned in the stitched configuration. While FIG. 3A depicts one initial configuration of the printheads 304A-304C for illustrative purposes, during process 200 the controller 50 operates one or more of the actuators 316A-316C to move the printheads from any initial position to place the inkjets in the activated printheads over the print medium 314. The stitched configuration enables the printheads 304A-304C to form printed images over wide print media in an efficient manner since there is little to no overlap between the inkjets in the printheads along the cross-process direction CP. However, in FIG. 3A, both the printheads 304B and 304C are located in positions where some or all of the inkjets in each printhead are unable to eject drops of ink onto the surface of the print medium 314.

FIG. 3A depicts the printhead 304B in a first position with a first portion 312 of the inkjets 308B in a position to eject ink onto the surface of the print medium 314. A second portion of the inkjets 313 is located beyond the edge of the print medium 314 in the cross-process direction CP when the printhead 304B is in the first position. The second portion of the inkjets 313 cannot eject ink drops onto the surface of the print medium 314.

FIG. 3B depicts the printhead 304A-304C from FIG. 3A after the controller 50 operates actuators to move the inkjets in the active printheads into a position to eject ink onto the print medium 314. In particular, the controller 50 operates the actuator 316B to move the printhead 304B in the cross-process direction CP from the first position of FIG. 3A to the second position that is depicted in FIG. 3B. In the second position of FIG. 3B, all of the inkjets 308B in the printhead 304B, including the first portion 312 and the second portion 313, are located in a position to eject ink onto the surface of the print medium 314. The activated printheads in the printhead array, including printheads 304A and 304B in FIG. 3B, cover the entire width of the document zone on the surface of the print medium 314 along the cross-process direction CP. During a printing operation, the printheads 304A and 304B remain stationary in the cross-process direction positions depicted in FIG. 3B while the print medium 314 moves in the process direction P through the print zone. All of the inkjets 308A in the printhead 304A are also positioned to eject ink onto the print medium 314. In the second position depicted in FIG. 3B, a portion of the inkjets in the printheads 304A and 304B overlap each other in the cross-process direction. A portion of the inkjets 324A in the plurality of inkjets 308A in the printhead 304A overlap with a subset of the inkjets 324B in the first portion of the inkjets 312 in the printhead 304B. As used herein, the term "overlap" as used to describe the alignment of inkjets in two or more printheads refers to different sets of inkjets in the printheads that are located in the same region of the print zone along the cross-process direction CP. Of course, the two printheads 304A and 304B are offset from each other in the process direction P, so the overlapping regions of inkjets in the two printheads occupy a single region along the cross-process direction CP but remain separated from each other along the process direction P. As described in more detail below, in FIG. 3B the printhead 304C is inactive since the inkjets in the printheads 304A and 304B can form printed images across the full width of the print medium 314, and a cap 332 covers the inkjets in the printhead 304C.

As depicted in FIG. 3B, the first portion of the inkjets 324A in the printhead 304A overlaps with the subset 324B in the first portion of the inkjets 312 in the printhead 304B when the printhead 304B is moved to the second position. In the embodiment of FIG. 3A and FIG. 3B, the printhead 304B includes a number of inkjets the overlapping subset of inkjets 324B that is either exactly or substantially (e.g. within 5%) equal to the number of inkjets that are in the second portion of the inkjets 313 in the printhead 304B. Thus, the number of inkjets the printhead 304B in the region of overlap in the position of FIG. 3B corresponds to the number of inkjets in the second portion of the inkjets 313 for the printhead 304B that are not in a position to eject ink into the print medium 314 in the position of FIG. 3A.

Figure 4A:
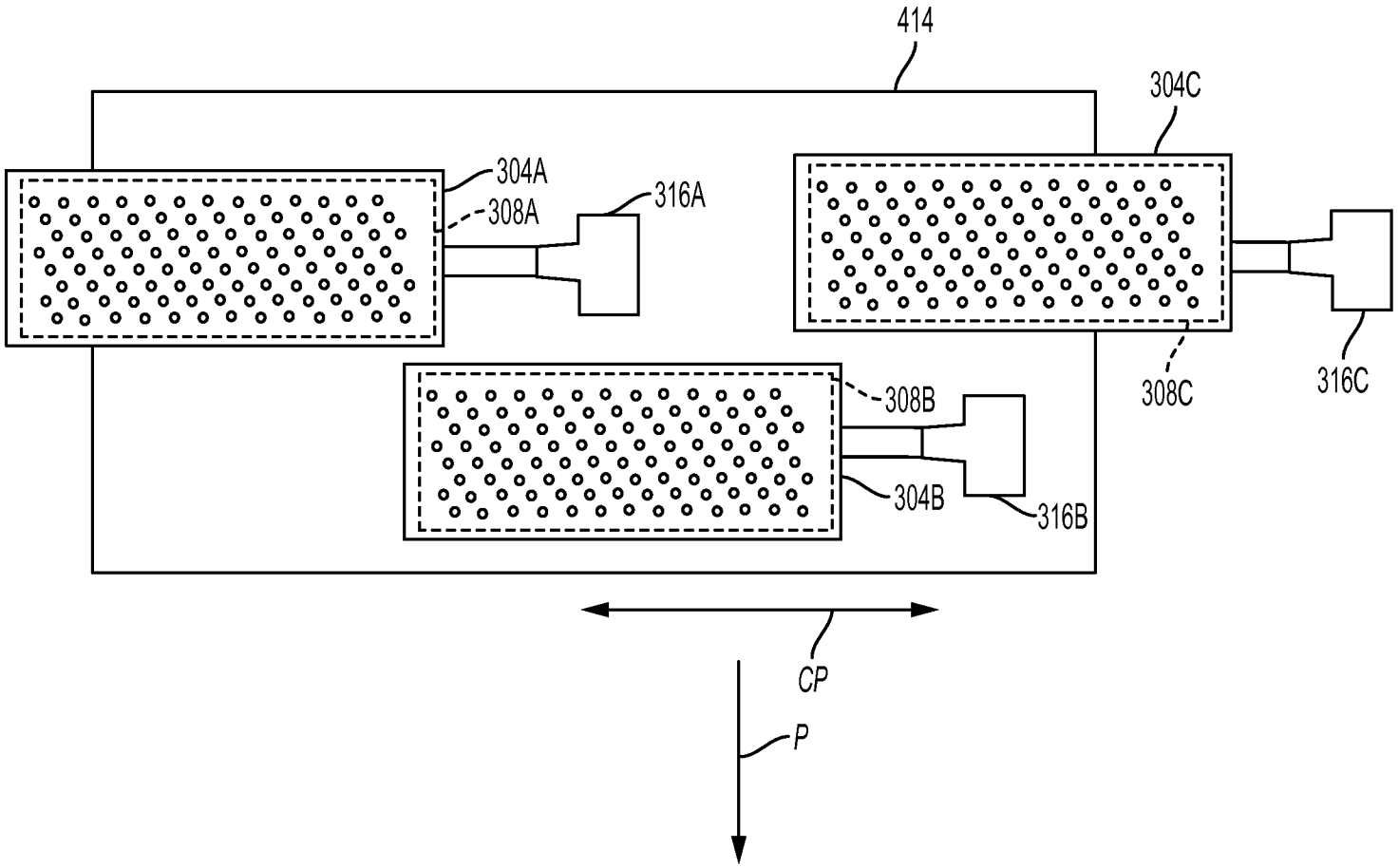
FIG. 4A is a schematic diagram of a portion of the printheads in a printhead array of the printer in FIG. 1 with another print medium having a second width.
Figure 4B:
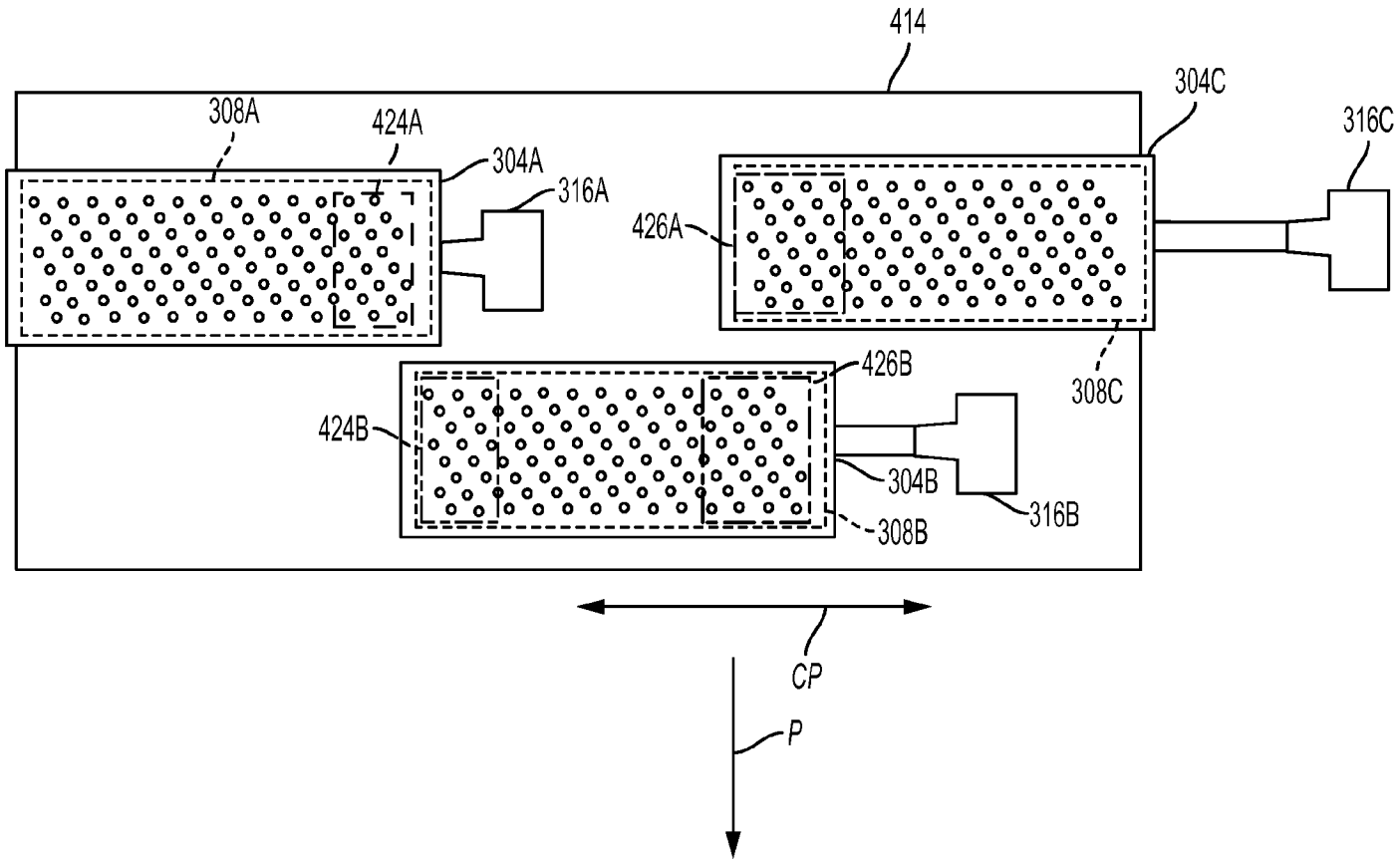
FIG. 4B is a schematic diagram of the printheads in FIG. 4A with two printheads being moved to a position to position all of the inkjets in both printheads over the print medium.

FIG. 4A depicts the printheads 304A-304C and actuators 316A-316C from FIG. 3A with a different print medium 414 that is wider along the cross-process direction CP than the print medium 314 from FIG. 3A and FIG. 3B. In FIG. 4A, a portion of the inkjets 308A in the printhead 304A and inkjets 308C in printhead 304C are positioned to eject ink onto the print medium 414 while another portion of the inkjets in both the printheads 304A and 304C are located beyond the edges of the print medium 414 in the cross-process direction CP. The controller 50 operates the actuators 316A and 316C to move all of the inkjets 308A in the printhead 304A and the inkjets 308C in the printhead 304C, respectively, over the surface of the print medium 414. FIG. 4B depicts the printheads 304A-304C with the printheads 304A and 304C moved to the positions where all of the inkjets in the active printheads are in a position to eject ink onto the print medium 414. The activated printheads in the printhead array, including printheads 304A, 304B and 304C in FIG. 4B, cover the entire width of the document zone on the surface of the print medium 414 along the cross-process direction CP. During a printing operation, the printheads 304A-304C remain stationary in the cross-process direction positions depicted in FIG. 4B while the print medium 414 moves in the process direction P through the print zone. In FIG. 4B, a portion of the inkjets 424A in the printhead 304A overlaps with another portion of the inkjets 424B in the printhead 304B in the cross-process direction CP. Another portion of the inkjets 426A in the printhead 304C overlaps with a portion of the inkjets 426B in the printhead 304B in the cross-process direction CP. Each of the printheads 304A-304C is active in the examples of FIG. 4A and FIG. 4B.

Referring again to FIG. 2, the process 200 continues as the controller caps one or more inactive printheads in the printhead array. In some instances, one or more printheads in the print zone 20 are inactive when only some of the printheads in each printhead array eject ink to form printed images on the media web 14. If one or more printheads are inactive, then the controller 50 operates the actuators in the print zone to move each inactive printhead to a maintenance unit or other suitable location for a capping device to place a cap over the nozzles of the inkjets in each inactive printhead (block 212). The maintenance unit includes a capping device that places a cap on the nozzles of each inactive printhead to reduce or eliminate the occurrence of inoperable inkjets due to the inkjets drying out while inactive. As depicted in FIG. 3B, the cap 332 covers the inkjets in the inactive printhead 304C. Each cap is, for example, a plastic member that forms a seal over the nozzles of the inkjets in the inactive printhead. During a print job, the inactive printheads remain sealed and the printer 5 returns the inactive printheads to operation if required to form printed images on a wider print medium in a subsequent print job.

The process 200 continues as the controller 50 identifies the overlapping portions of the inkjets in the active printheads (block 216). As depicted in FIG. 3B and FIG. 4B, portions of the inkjets in two or more active printheads overlap each other in the cross-process direction. The controller 50 identifies the overlapping sets of inkjets in the active printheads based on the relative positions of each printhead in the cross-process direction and the predetermined size and arrangement of the inkjets in each printhead.

Process 200 continues as the printer 5 operates the inkjets in the active printheads to form a printed image on the surface of the print medium (block 220). The controller 50 operates selected the inkjets in the activated printheads with reference to the stored image data 68 to form printed images on the media web 14. In one configuration, the printer 5 forms a series of images that each correspond to a single printed document, such as multiple copies of a single printed page in a book or other printed document. In other configurations, the stored image data 68 include multiple images and the printer 5 prints multiple copies of the stored images in a predetermined order, such as printing a plurality of copies of a multi-page document.

During the printing process for many images, one or more of the inkjets in the overlapping regions of the active printheads eject ink drops to form portions of the printed image. Operating multiple inkjets that are aligned with each other in the cross-process direction in the overlapping regions to form a single pixel in the printed image would produce an image artifact since other portions of the printheads that do not overlap only form each printed pixel using a single inkjet. The portions of the image that correspond to overlapping regions of the printheads would appear abnormally dark compared to other portions of the image from non-overlapping regions of the printheads. Alternatively, only using one inkjet in the overlapping regions to form the printed image would prevent another inkjet in another active printhead from ejecting ink, which could lead to the ink drying out and producing an inoperable inkjet.

In the process 200, the controller 50 operates inkjets in the overlapping regions of the printheads proportionally to form printed images with uniform levels of ink for each pixel location in the entire printed image and to ensure that multiple aligned inkjets in different printheads eject ink during the print job to reduce or eliminate the occurrences of inoperable inkjets (block 224). As used herein, the term "proportionally" refers to the operation of the inkjets with the controller 50 to operate only one inkjet in the overlapping regions of the printheads to form a mark corresponding to a single pixel in the image data 68 and selecting different inkjets that are aligned with each other in the cross-process direction to form different pixels in the image data that correspond to a single location in the cross-process direction.

Figure 5:
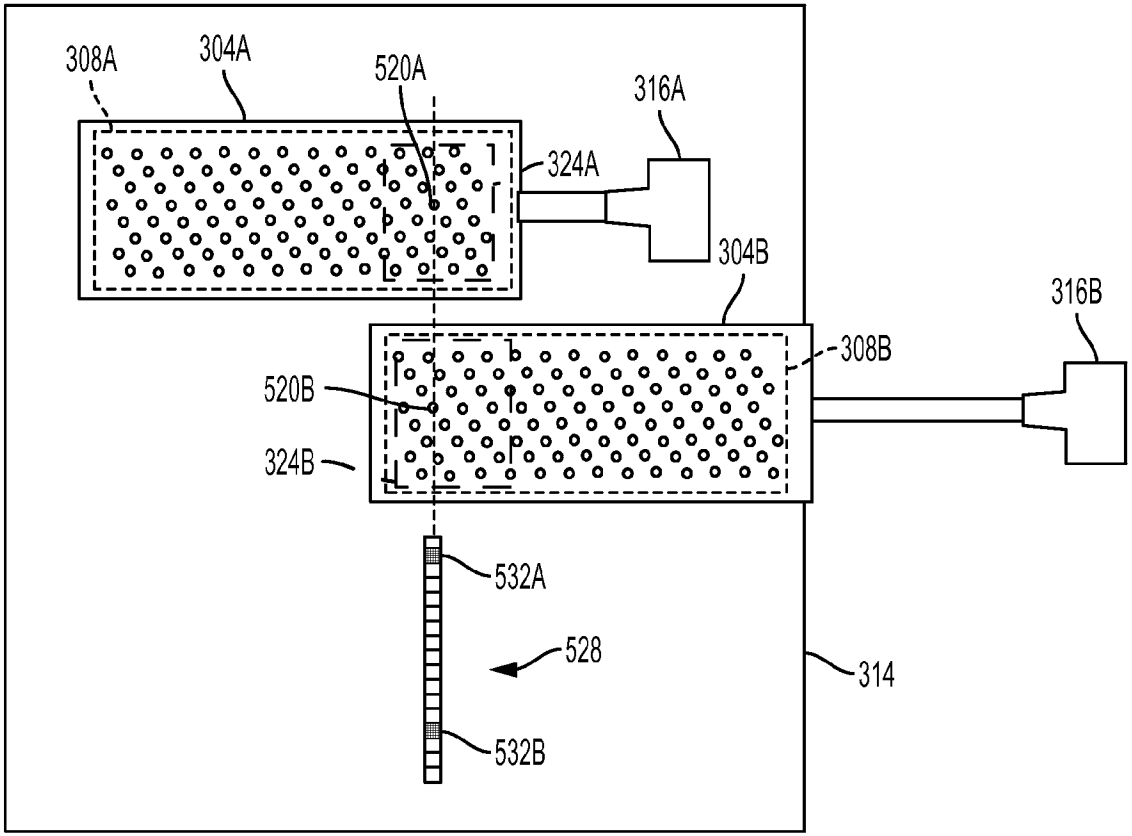
FIG. 5 is a diagram that depicts pixels of image data in a single cross-process direction that is aligned with two inkjets in overlapping regions of two printheads over a print medium.

For example, FIG. 5 depicts the printheads 304A and 304B with the overlapping sets of inkjets 324A and 324B, respectively. Multiple inkjets in the overlapping regions 324A and 324B are aligned with each other in the cross-process direction, with FIG. 5 depicting the inkjet 520A in the printhead 304A in alignment with the inkjet 520B in the printhead 304B for illustrative purposes. FIG. 5 also includes a graphical depiction of a single set of pixels 528 in the stored image data 68 that corresponds to the cross-process direction locations of both the inkjets 520A and 520B. In the column 528, the pixels 532A and 532B correspond to locations in the two-dimensional printed image that receive ink drops to form a portion of the printed image on the surface of the print medium 314. In one embodiment, the controller 50 operates only one of the inkjets 520A or 520B (e.g. 520A) to eject ink for the first pixel 532A and the controller 50 operates the other inkjet (e.g. 520B) to eject ink for the second pixel 532B. Thus, the controller 50 operates the inkjets 520A and 520B in the proportional manner where only one inkjet forms each printed pixel and different inkjets form different pixels in the stored image data. In some configurations, the controller 50 operates the inkjets with uniform proportions, such as operating each of two aligned inkjets for one-half of the pixels in the image data, although alternative configurations do not necessarily have to use uniform proportions.

In another embodiment, the controller 50 operates the inkjets in the overlapping regions in a proportional manner based on a per-image basis for multiple copies of an image instead of on a per-pixel basis within a single image. For example, the printer 5 performs some print jobs to print multiple copies of a single page or a single document. The controller 50 operates one inkjet in the overlapping region to eject ink for each of the corresponding pixels in one page in the print job, and subsequently selects a different inkjet for another copy of the page. For example, in FIG. 5 the controller 50 operates only the inkjet 520A to eject ink for the pixels 532A and 532B for one copy of the printed image, and the controller 50 operates only the inkjet 520B to eject ink for the pixels 532A and 532B in another copy of the printed image.

In some instances, one of two or more overlapping inkjets becomes inoperable during a printing operation. For example, in FIG. 5 the inkjet 520A in the portion of the inkjets 324A may become inoperable during a print job while the corresponding overlapping inkjet 520B in the subset of the inkjets 324B remains operable. The printer 5 optionally implements an inoperable inkjet detection process to identify any inoperable inkjets in the printheads within the print zone 20. Such inoperable inkjet detection processes are known to the art and are not discussed in further detail herein. If an inkjet becomes inoperable during the printing operation of block 224, the controller 50 deactivates the inkjet that becomes inoperable (e.g. inkjet 520A in FIG. 5) and only operates the remaining operable inkjet (e.g. inkjet 520B in FIG. 5) to eject drops corresponding to pixels in the image data during the printing operation. During process 200 the operable inkjet compensates for the inoperable inkjet to reduce or eliminate the occurrence of streaks or other artifacts in the printed images.

Referring again to FIG. 2, during the process 200, the controller 50 also operates any inkjets in the active printheads that do not eject ink to form the printed image to eject ink drops onto one or both of an inter-document zone on the surface of the print medium or to eject drops in a sparse pattern within the document zone of the printed image (block 228). In some imaging operations, only a portion of the inkjets in each active printhead ejects ink to form the printed image. Other inkjets that are located in the margins of the print medium or even inkjets that do not correspond to any pixels in the printed image may not operate to form printed images during the print job. In one configuration, controller 50 operates the inkjets that do not form portions of the printed images during the print job to reduce or eliminate the occurrences of clogged and inoperable inkjets. In the printer 5, the controller 50 operates the inkjets to eject ink into inter-document zones between printed images on the media web 14 or in other margin regions of the print medium that are outside of the printed images. In some embodiments, the controller 50 forms printed test patterns using all of the inkjets in the active printheads at different times during the print job, which enables each inkjet in the activated printheads to eject drops of ink. In some embodiments, the controller 50 operates the inkjets in the active printheads to ensure that no inkjet remains idle for greater than a predetermined period of time (e.g. 20 minutes) to reduce the likelihood that the liquefied ink in any of the inkjets dries out and produces inoperable inkjets. Alternative printer embodiments that form printed images on individual media sheets may not have access to inter-document zones to form test patterns or otherwise operate the all of the inkjets in the activated printheads. In these embodiments, a controller operates the otherwise unused inkjets to form a sparse pattern of drops within the document zone. The sparse pattern of ink drops covers a very small portion of the surface of the document zone and is dispersed across the area of the document zone so the sparse pattern is effectively imperceptible so as to have little or no impact on the image quality of the printed image in the document zone.

As described above, the printer 5 performs the process 200 for each set of printheads in the color units 21A-21D to position the inkjets in each active printhead over the surface of the media web 14 and caps any inactive printheads. While the printer 5 depicts a continuous feed printer that forms printed images on the elongated media web 14, alternative printer embodiments that form printed images on individual media sheets can also perform the process 200 to maintain the operation of inkjets in printhead arrays.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating printheads in a printer comprising:

operating with a controller a first actuator to move in a cross-process direction a first printhead having a first plurality of inkjets from a first position at which only a first portion of the first plurality of inkjets are positioned to eject ink onto a surface of a print medium and a second portion of the first plurality of inkjets are not positioned to eject ink onto the surface of the print medium and halts movement of the first printhead at a second position at which both the first portion and the second portion of the first plurality of inkjets are positioned to eject ink onto the print medium and a subset of the first portion of the first plurality of inkjets overlaps in the cross-process direction with a first portion of a second plurality of inkjets in a second printhead; and operating with the controller a plurality of inkjets in each printhead of a plurality of printheads including the first plurality of inkjets in the first printhead and the second plurality of inkjets in the second printhead to eject drops of ink across a full width of a document zone on the surface of the print medium while each printhead in the plurality of printheads remains stationary in the cross-process direction.

2. The method of claim 1 further comprising:

identifying with the controller the subset of the first portion of the first plurality of inkjets in the first printhead that overlaps in the cross-process direction with the first portion of the second plurality of inkjets in the second printhead when the first printhead is in the second position;

identifying with the controller a first pixel and a second pixel in image data for a printed image in a single cross-process direction location corresponding to a first inkjet in the subset of the first portion of the first plurality of inkjets and a second inkjet in the first portion of the second plurality of inkjets;

operating with the controller only one of the first inkjet and the second inkjet to eject ink onto the print medium for the first pixel in the printed image; and operating with the controller only one of the first inkjet and the second inkjet to eject ink for the second pixel in the printed image.

3. The method of claim 1 further comprising:

operating with the controller each of the first plurality of inkjets in first printhead and each of the second plurality of inkjets in the second printhead to eject ink onto the print medium to reduce or eliminate occurrences of inoperable inkjets in the first printhead and the second printhead.

4. The method of claim 1 further comprising:

operating with the controller a second actuator to move the second printhead to a second position in the cross-process direction to enable each inkjet in the second plurality of inkjets in the second printhead to eject ink onto the surface of the print medium.

5. The method of claim 1 further comprising:

operating with the controller a second actuator to move a third printhead having a third plurality of inkjets to another position in the cross-process direction where none of the third plurality of inkjets are positioned to eject ink onto the surface of the print medium; and operating with the controller a capping device to cap the third plurality of inkjets in the third printhead to reduce or eliminate occurrences of inoperable inkjets in the third printhead.

6. The method of claim 2 further comprising:

identifying with the controller a width of the print medium; and prior to operating the first actuator to move the first printhead to the second position, identifying with the controller the second position for the first printhead with reference to a predetermined first width of the first plurality of inkjets in the first printhead and the width of the print medium.

7. The method of claim 6 further comprising:

identifying with the controller the subset of the first portion of the first plurality of inkjets and the first portion of the second plurality of inkjets in the second printhead with reference to the predetermined first width of the first plurality of inkjets in the first printhead, the second position of the first printhead, a second predetermined width of the second plurality of inkjets in the second printhead, and a third position of the second printhead in the cross-process direction.

8. The method of claim 2 further comprising:

operating with the controller at least one inkjet in the first plurality of inkjets to eject ink onto a region of the print medium outside of the printed image to reduce or eliminate occurrences of inoperable inkjets in the first printhead.

9. The method of claim 2, the operation of the first inkjet and the second inkjet further comprising:

operating with the controller only the first inkjet to eject ink onto the print medium for the first pixel and only the second inkjet to eject ink onto the print medium for the second pixel.

10. The method of claim 2, the operation of the first inkjet and the second inkjet further comprising:

operating with the controller only the first inkjet to eject ink onto the print medium for the first pixel and the second pixel for one copy of the printed image; and operating with the controller only the second inkjet to eject ink onto the print medium for the first pixel and the second pixel for another copy of the printed image.

11. The method of claim 1 wherein the movement in the cross-process direction of the first printhead from the first position to the second position moves a first number of inkjets in the second portion of the first plurality of inkjets into position to eject ink onto the image receiving surface and moves a second number of inkjets in the subset of the first portion of the first plurality of inkjets into a location that overlaps the first portion of inkjets in the second plurality of inkjets in the second printhead, the first number of inkjets being substantially equal to the second number of inkjets.

12. The method of claim 2 further comprising:

deactivating with the controller the first inkjet in response to the first inkjet becoming inoperable; and operating with the controller only the second inkjet to eject ink for the first pixel and the second pixel in the printed image to compensate for the first inkjet.

13. An inkjet printer comprising:

a plurality of printheads in a print zone including a first printhead having a first plurality of inkjets and a second printhead having a second plurality of inkjets;

a first actuator operatively connected to the first printhead and configured to move the first printhead in a cross-process direction; and a controller operatively connected to the first printhead, the second printhead, and the first actuator, the controller being configured to:

operate the first actuator to move in a cross-process direction the first printhead from a first position at which only a first portion of the first plurality of inkjets are positioned to eject ink onto a surface of a print medium in the print zone and a second portion of the first plurality of inkjets are not positioned to eject ink onto the surface of the print medium and halt movement of the first printhead at a second position at which both the first portion and the second portion of the first plurality of inkjets are positioned to eject ink onto the print medium and a subset of the first portion of the first plurality of inkjets overlaps in the cross-process direction with a first portion of the second plurality of inkjets in a second printhead; and operate the plurality of inkjets each printhead of a plurality of printheads including the first plurality of inkjets in the first printhead and the second plurality of inkjets in the second printhead to eject drops of ink across a full width of a document zone on the surface of the print medium while each printhead in the plurality of printheads remains stationary in the cross-process direction.

14. The printer of claim 13, the controller being further configured to:

identify the subset of the first portion of the first plurality of inkjets in the first printhead that overlaps in the cross-process direction with the first portion of the second plurality of inkjets in the second printhead when the first printhead is in the second position;

identify a first pixel and a second pixel in image data for a printed image in a single cross-process direction location corresponding to a first inkjet in the subset of the first portion of the first plurality of inkjets and a second inkjet in the first portion of the second plurality of inkjets;

operate only one of the first inkjet and the second inkjet to eject ink onto the print medium for the first pixel in the printed image; and operate only one of the first inkjet and the second inkjet to eject ink for the second pixel in the printed image.

15. The printer of claim 13, the controller being further configured to:

operate each of the first plurality of inkjets in first printhead and each of the second plurality of inkjets in the second printhead to eject ink onto the print medium to reduce or eliminate occurrences of inoperable inkjets in the first printhead and the second printhead.

16. The printer of claim 13 further comprising:

a second actuator operatively connected to the second printhead and configured to move the second printhead in the cross-process direction; and the controller being operatively connected to the second actuator, the controller being further configured to:

operate the second actuator to move the second printhead to a third position in the cross-process direction to enable each inkjet in the second plurality of inkjets in the second printhead to eject ink onto the surface of the print medium in the print zone.

17. The printer of claim 13 further comprising:

a third printhead having a third plurality of inkjets;

a third actuator operatively connected to the third printhead and configured to move the third printhead in the cross-process direction;

a capping device; and the controller being operatively connected to the third actuator and the capping device, the controller being further configured to:

operate the third actuator to move the third printhead to another position in the cross-process direction where none of the third plurality of inkjets are positioned to eject ink onto the surface of the print medium; and operate the capping device to cap the third plurality of inkjets in the third printhead to reduce or eliminate occurrences of inoperable inkjets in the third printhead.

18. The printer of claim 14, the controller being further configured to:

identify a width of the print medium; and prior to operation of the first actuator to move the first printhead to the second position, identify the second position for the first printhead with reference to a predetermined first width of the first plurality of inkjets in the first printhead and the width of the print medium.

19. The printer of claim 18, the controller being further configured to:

identify the subset of the first portion of the first plurality of inkjets and the second portion of the second plurality of inkjets with reference to the predetermined first width of the first plurality of inkjets in the first printhead, the second position of the first printhead, a second predetermined width of the second plurality of inkjets in the second printhead, and a third position of the second printhead in the cross-process direction.

20. The printer of claim 13, the controller being further configured to:

operate at least one inkjet in the first plurality of inkjets to eject ink onto a region of the print medium outside of the printed image to reduce or eliminate occurrences of inoperable inkjets in the first printhead.

21. The printer of claim 14, the controller being further configured to:

operate only the first inkjet to eject ink onto the print medium for the first pixel and only the second inkjet to eject ink onto the print medium for the second pixel.

22. The printer of claim 14, the controller being further configured to:

operate only the first inkjet to eject ink onto the print medium for the first pixel and the second pixel for one copy of the printed image; and operate only the second inkjet to eject ink onto the print medium for the first pixel and the second pixel for another copy of the printed image.

23. The printer of claim 13, wherein the operation of the actuator to move the first printhead from the first position to the second position moves a first number of inkjets in the second portion of the inkjets in the first plurality of inkjets into position to eject ink onto the image receiving surface and moves a second number of inkjets in the subset of the first portion of inkjets in the first plurality of inkjets into a location that overlaps the first portion of inkjets in the second plurality of inkjets, the first number of inkjets being substantially equal to the second number of inkjets.

24. The printer of claim 14, the controller being further configured to:

deactivate the first inkjet in response to the first inkjet becoming inoperable; and operate only the second inkjet to eject ink for the first pixel and the second pixel in the printed image to compensate for the first inkjet.

* * * * *